United States Patent [19]

Schoenholz et al.

[11] 4,384,988

[45] May 24, 1983

[54] FIRE PROTECTION WATER BARRIER WHICH IS A GEL COMPOSITION OF HIGH WATER CONTENT AND HIGH VISCOSITY

[75] Inventors: Daniel Schoenholz, Basking Ridge; Charles B. Parisek, Morristown, both of N.J.

[73] Assignee: L.M.C. Inc., Santa Fe, N. Mex.

[21] Appl. No.: 221,823

[22] Filed: Dec. 31, 1980

Related U.S. Application Data

[63] Continuation-in-part of Ser. No. 138,866, Apr. 10, 1980, abandoned.

[51] Int. Cl.[3] ..... C08L 61/28

[52] U.S. Cl. ..... 252/610; 106/203; 252/611; 524/47; 524/548; 524/560

[58] Field of Search ..... 252/610, 611; 524/47, 524/548, 560; 106/203

[56] References Cited

U.S. PATENT DOCUMENTS

| | | | |
|---|---|---|---|
| 3,341,319 | 9/1967 | Hibbard | 524/548 |
| 3,984,334 | 10/1976 | Hopper | 252/610 |
| 4,101,485 | 7/1978 | Brooks et al. | 252/603 |

FOREIGN PATENT DOCUMENTS

| | | |
|---|---|---|
| 1223701 | 8/1966 | Fed. Rep. of Germany . |
| 2104061 | 8/1971 | Fed. Rep. of Germany . |

*Primary Examiner*—Maurice J. Welsh

*Attorney, Agent, or Firm*—Hammond & Littell, Weissenberger and Muserlian

[57] ABSTRACT

This invention relates to a water barrier gel composition comprising from about 0.1 to 5% by weight of water absorbent material and from about 95 to 99.9% by weight of water, based on the weight of the total composition, and a method of applying a layer of said water-barrier gel composition to a surface to prevent ignition or to protect the surface from heat damage.

16 Claims, 2 Drawing Figures

FIRE PROTECTION WATER BARRIER WHICH IS A GEL COMPOSITION OF HIGH WATER CONTENT AND HIGH VISCOSITY

PRIOR APPLICATION

This application is a continuation-in-part application of commonly assigned, copending U.S. patent application Ser. No. 138,866, filed Apr. 10, 1980, now abandoned.

FIELD OF THE INVENTION

This application relates to a composition and method for protecting flammable materials. More particularly, the compositions comprise up to about 99.9 percent by weight of water which has been immobilized so that thick layers can be retained upon horizontal and sloping surfaces as well as vertical and overhead surfaces.

BACKGROUND OF THE INVENTION

Ignition of a flammable structure or other materials such as trees downwind from a forest fire, brush fire, or another burning building is generally caused by wind-carried burning embers which fall on roofs or which strike a wall and fall to the ground next to the structure or otherwise make contact with it. The main method of protecting a threatened building is to hose the roof of the building with water to wet any portion which may be exposed to ignition. However, often the water supply or water pressure is inadequate or the temperature is so high and humidity so low that rapid drying occurs. Also, many flammable surfaces are relatively non-absorbent so that they retain little water.

OBJECTS OF THE INVENTION

It is an object of the invention to provide a fire-protective water barrier.

It is also an object of the invention to provide a water barrier comprised of a high water content composition which can be applied to horizontal, sloping, vertical or overhead surfaces in a thickness up to about one inch without running or sliding off, thus providing an effective means for extinguishing sources of ignition and maintaining the temperature of the treated surface below its ignition point.

It is further an object of the invention to provide a method for preventing ignition of surfaces which comprises administering a layer of a water barrier composition comprised of from about 0.1 to 5 percent by weight of water absorbent material and from about 95 to 99.9 percent by weight of water.

These and other objects of the invention will become more apparent from the description below.

DESCRIPTION OF THE INVENTION

Figure 1:
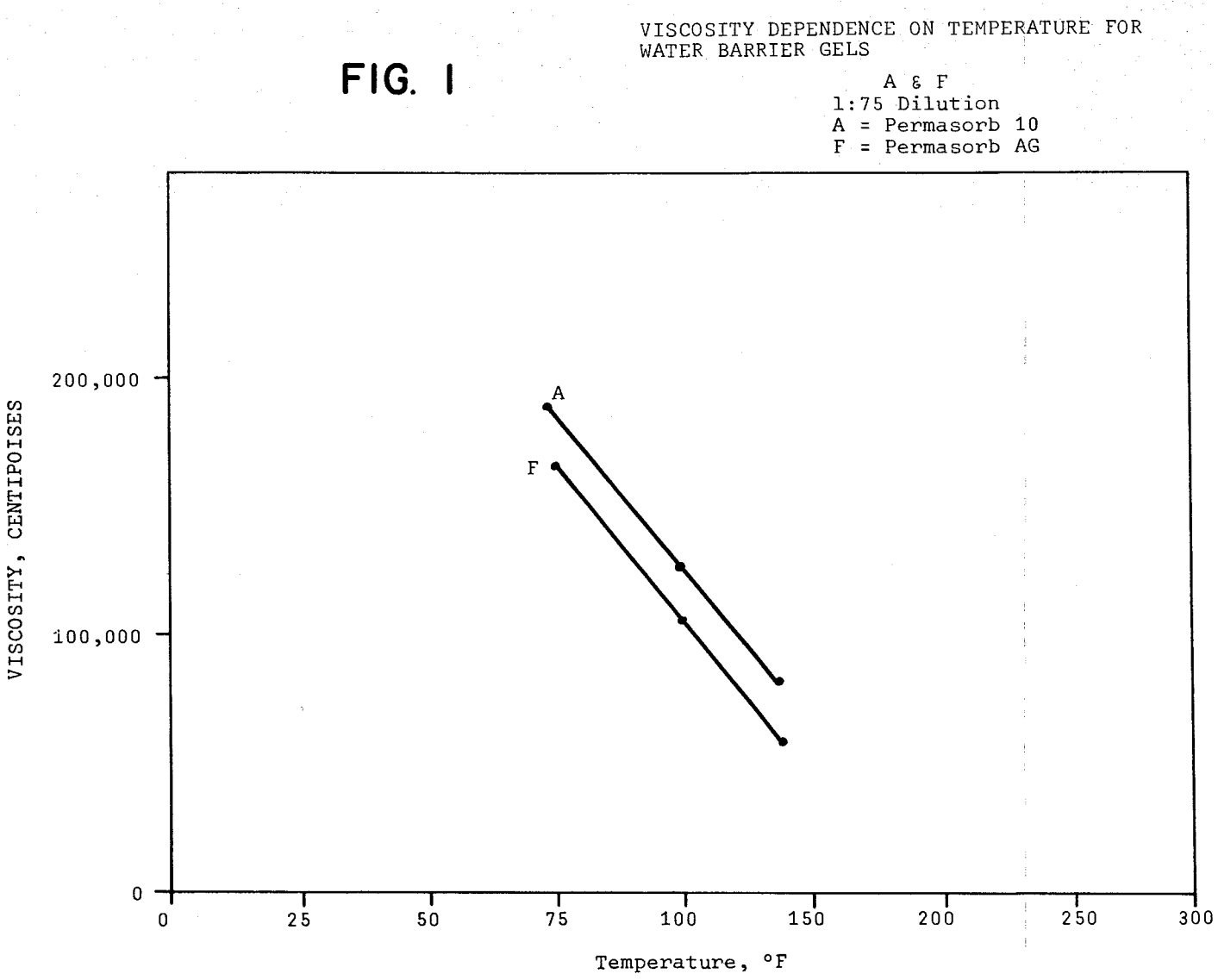
FIG. 1 is a graph which represents the relationship between gel viscosity and temperature for two gel compositions of the invention.

It has been found that certain surfaces which might otherwise ignite or be damaged by heat can be protected by application of a coating of a high water-content composition. The compositions are comprised primarily of water and a small amount of material selected from high capacity water absorbents. Such water absorbents are granular or powdered materials which have the characteristic of absorbing large amounts of water and swelling to many times their original volume thus converting water to a gel-like relatively immobile mass.

Examples of useful high water absorbents include insoluble acrylic polymers and mixtures and copolymers thereof and starcharcylic block polymers. Also useful are acrylic polymers such as Permasorb 10, Permasorb 29, Permasorb 30, and Permasorb AG, available from National Starch; starch and acrylic polymer mixtures such as SGP 104 and SGP 502S, available from Henkel Corp; and starch and acrylic polymer mixtures such as Polymer 35-A-100 and Polymer 35-B-100, available from Grain Processing. Other hydrophilic polymers include polyvinylpyrrolidone sold under the mark NPK-30, borated dextrin sold under the mark Nadex 935 and methylcellulose sold under the mark methocel A4M.

Preferred super absorbent polymers are granular, high-molecular weight acrylic polymers containing hydrophilic carboxylate groups. These polymers are water insoluble but swell rapidly in water and are sold under the tradename Permasorb. Permasorb 30 is most preferred as it mixes easily and is less dusty, although Permasorb AG is also very useful.

A particularly preferred composition of the invention for the formation of the water barrier compositions is comprised of 40 to 60% by weight of water insolubilized acrylic polymers, 40 to 60% by weight of a low salt content, carboxymethyl cellulose and up to 0.5% by weight of a low salt content non-cationic surfactant, especially dioctyl sodium sulfonsuccinate which is sold under the mark Aerosol OT or the non-ionic sold under the mark Triton X-100, Darvan 1 or Darvan 6 and Daxad 11G. Especially preferred are compositions containing approximately equal parts by weight of Permasorb 30 and carboxymethylcellulose containing 0.1 parts by weight of Aersol OT.

The water barrier compositions of the invention can be readily prepared by mixing the water absorbent materials with water in desired proportions. The water barrier compositions will, in practice, be gels comprised from about 95 to 99.9% by weight of water and from about 0.1 to 5% by weight of absorbent material, based on the weight of the final product. Preferably, the water barrier composition gels used comprise from about 98 to 99.9% by weight of water and from about 0.1 to 2% by weight of absorbent material.

The water barrier compositions can be prepared, in most instances, any time prior to use. However, it is preferred that suitable water absorbent material be admixed with water at the site of use to eliminate the costs and difficulties associated with the transportation and handling of the final water barrier compositions, which are fairly heavy due to the presence of large volumes of water. Such on site preparation will, of course, vary according to water availability, timeliness and other factors.

The water barrier gel compositions of the invention can be prepared by physical admixture in a suitable container, such as a rotary mixer, vat, or the like. The ease of admixture or blending tends to vary according to the water absorbent material used. For example, some water absorbent materials tend to clump upon being wetted, which makes the admixture procedure more laborious and difficult. On the other hand, a material such as Permasorb 30 or AG, which requires relatively little mixing effort and the shortest mixing time, shows little tendency to clump and can form a useful gel composition after about twenty minutes of mixing at room temperature.

The water may be taken from any available source as long as it does not contain a high level of salts. For example, swimming pool water may usually be used as it has a low concentration of ionizable salts but sea water may not be used as the gels formed are unstable in the presence of the ionized salts in sea water.

The water barrier gel composition can be applied to the surface to be protected, such as the ground about a structure and on the structure in case of brush fires as occur in the Western United States or on the dry brush per se to act as a fire barrier by either spreading the composition with a shovel, rake, or other suitable tool or device, or by pumping the composition through a hose by means of a suitable pump. The water barrier composition should be applied in a suitable thickness, preferably from about 1 to 2 inches. On a sloping surface, such as a roof, a thickness of up to about 1 inch can usually be applied where the roof angle from the horizontal is up to about 45°. The water barrier compositions are also useful to prevent heat transfer to prevent internal temperature increases in a structure over a period of time.

The water barrier gel compositions may be applied to a horizontal or sloping surface such as a roof. Preferably, a sloping surface will not have a slope greater than about 45° from the horizontal; however, the treated surface may have a greater slope, and may even be vertical or overhead, so long as the water barrier composition remains substantially in place. It is within the scope of the invention that a water barrier composition may be applied to a vertical surface or a surface with an angle from the horizontal greater than 45°, as long as the gel formed employs a compositions and concentration which is sufficiently viscous and tacky to remain in place.

The relationship between viscosity and temperature for water barrier compositions of the invention, are shown in FIG. 1. It can be seen that there is typically a linear relationship, in the temperature range of 75° to 110° F., between viscosity and temperature as exemplified for water barrier compositions comprised of one part by weight of Permasorb 10 or Permasorb AG and 75 parts by weight of water. It should be noted that while, for example, the viscosity of the compositions decreases by as much as 33 percent as 100° F. as compared to 72° F., the viscosity at 100° F. is still high enough to prevent running or flow of the gel compositions.

The following examples are intended to illustrate the invention and are not to be construed as limiting the invention thereto.

EXAMPLES

EXAMPLES I–XIV

Water barrier compositions were prepared by admixing water absorbent materials with water in weight ratios of 1 to 75 and 1 to 150, and certain physical properties of the resulting gels were measured. The results of the testing are set forth in the following table:

TABLE

| Example | Absorbent | Dilution | Viscosity (cps at 75° F.) | Adhesion[a] | Pourability[b] | Mixability[c] |
|---|---|---|---|---|---|---|
| I | Permasorb 10 | 1 to 75 | 187,500 | 1.25 | — | 3 |
| II | Permasorb 10 | 1 to 150 | 28,000 | — | 2 | 3 |
| III | Permasorb 30 | 1 to 75 | 387,500 | 1.50 | — | 3 |
| IV | Permasorb 30 | 1 to 150 | 26,000 | — | 2 | 3 |
| V | Permasorb AG | 1 to 75 | 168,750 | 1.25 | — | 1 |
| VI | Permasorb AG | 1 to 150 | 6,000 | — | 2 | 1 |
| VII | SGP 104 | 1 to 75 | 162,500 | 0.75 | — | 1 |
| VIII | SGP 104 | 1 to 150 | 21,000 | — | 1 | 1 |
| IX | SGP 502S | 1 to 75 | 112,500 | 1 | — | 3 |
| X | SGP 502S | 1 to 150 | 29,000 | — | 3 | 3 |
| XI | Polymer 35-A-100 | 1 to 75 | 187,500 | 2 | — | 2 |
| XII | Polymer 35-A-100 | 1 to 150 | 3,000 | — | 3 | 2 |
| XIII | Polymer 35-B-100 | 1 to 75 | 162,500 | 0.75 | — | 1 |
| XIV | Polymer 35-B-100 | 1 to 150 | 1,000 | — | 3 | 1 |

[a]Thickness (inches) of non-running layer on 30° sloping roof
[b]Pourability Code: 1 = difficult to pour, flows as plug; 2 = molasses-like; 3 = flows freely, water-like.
[c]Mixability Code: 1 = mixes easily, minimum lumping; 2 = mixes easily, some tendency to lump; 3 = marked tendency to form lumps.

Figure 2:
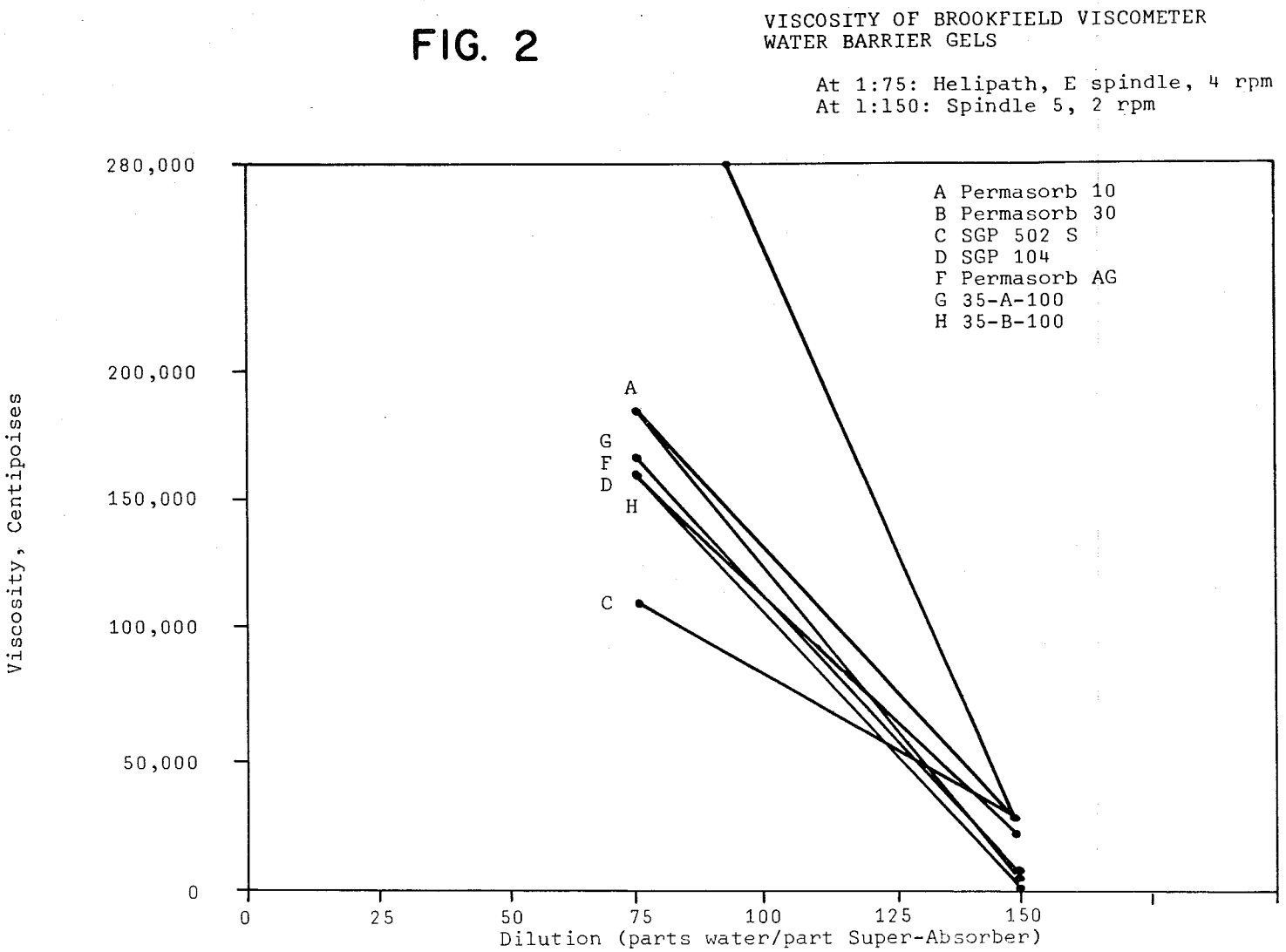
FIG. 2 is a graph which represents characteristics of certain compositions of the invention.

The relationship of viscosity to dilution for the various compositions described in the Table is set forth in FIG. 2.

EXAMPLE XV

A water barrier composition was prepared by admixing 1 part by weight of Permasorb AG with 75 parts by weight of water. The composition, which was in the form of a gel, was applied in a 1 inch layer to part of a 2×4 foot section of a cedar shake roof. The roof section was saturated with petroleum naphtha, which was then ignited and permitted to burn. The unprotected portion of the roof was severly burned, while the portion having the water barrier composition was virtually unaffected.

EXAMPLE XVI

A gel composition similar to that prepared in Example XV was applied in a 1 inch layer to portions of a section of asphalt shingle roof. The section of asphalt shingle roof was heaped with burning wooden sticks. The burning wooden sticks on portions of the roof in contact with the gel were quickly extinguished with no noticeable damage to the underlying portions.

EXAMPLE XVII

Each of Examples XV and XVI was repeated with the exception that the water barrier composition was a 1 to 200 dilution and the gel layer was only ¼ to ½ inch thick. In each instance, there was no noticeable damage to the roof portion of the roof covered by the gel layer.

EXAMPLE XVIII

Gel compositions containing 1 part by weight of a super-absorbent polymer such as Permasorb AG and 75 parts by weight of water were applied in one inch thick layers to surfaces that sloped up to 30° from the horizontal. The compositions were sufficiently rigid and tacky to remain in place for at least 12 hours. In addition, a ⅛ to ¼ inch layer of a gel comprised of 1 part by weight of Permasorb AG to 50 parts by weight of water adhered to a vertical wood surface for about four hours.

EXAMPLE XIX

Gel compositions were prepared from 1 part by weight of Permasorb AG and 75, 100, 150, 200 and 250 parts by weight, respectively, of water. Each gel composition was placed in a 1 inch layer on an asphalt shingle roof section positioned at a 30° angle from the horizontal.

The gel containing 75 parts by weight of water remained in place for at least 12 hours, no flow being observed. The gel containing 200 parts by weight of water remained in place for more than eight hours with virtually no observable flow. The most dilute gel composition, the one having 250 parts by weight of water, flowed rapidly, i.e., at about one foot/minute, down the sloped surface, leaving a gel layer about ⅛ inch thick that remained for six hours.

EXAMPLE XX

A 1 inch layer of a gel composition comprised of 1 part by weight of Permasorb AG and 75 parts by weight of water was applied to an asphalt shingle section positioned at a 30° angle from the horizontal. The gel composition did not flow. Subsequently the gel layer was contacted with the flame from a propane blow torch, and after two minutes of direct heating, the gel composition did not flow.

EXAMPLE XXI

A 1 inch layer of the gel composition described in Example XX was applied to a horizontal asphalt roof section. The gel composition was heated at 120° F., and it was determined that the rate of evaporation was the same as that of pure water.

The gel layer evaporated to dryness after about forty-eight hours. The remaining, dried absorbent polymer material was rewetted with 75 parts by weight of water; however, rehydration was more difficult to achieve than with the original preparation since the composition remained lumpy longer and required longer stirring.

EXAMPLE XXII

A gel composition A comprising a mixture of 1 part by weight of Permasorb 30, 1 part by weight of carboxymethyl-cellulose, 0.1 parts by weight of Aerosol OT diluted with 100 parts of water was compared with a gel composition B of 1 part by weight of Permasorb 30 diluted with 100 parts by weight of water. The gel compositions were uniformly applied at a thickness of 1 inch to 1 foot × 1 foot vertical wood surfaces, overhead wood surfaces, overhead concrete and vertical metal surfaces. In all instances, the composition containing carboxymethylcellulose and Aerosol OT had a superior adhesion than the gel containing only Permasorb 30.

The stability of the gels was compared at room temperature by measuring the viscosity 24 hours and one week after the gel was prepared and the results are reported in the following Table.

TABLE

| Composition | Viscosity in cps × 1000 at 23° C. After 24 hours | After 1 week |
|---|---|---|
| A | 134–136 | 128–134 |
| B | 88–92 | 144–154 |

The results of the Table show that composition A had superior gel properties versus composition B with regard to time to reach a maximum viscosity.

EXAMPLE XXIII

Gel compositions comprising 1 part by weight of Permasorb 30 and 1 part by weight of either polyvinylpyrrolidone or methylcellulose or borated dextrin diluted with 100 parts by weight of water were compared with a gel composition B comprising 100 parts by weight of water and 1 part by weight of Permasorb. The gel compositions were uniformly applied to 1 foot by 1 foot vertical wood and metal surfaces and overhead wood surfaces at a thickness of one inch. In most instances, the two component compositions had an adhesion equal to or superior to the adhesion of gel composition B.

Various modification of the compositions and method of the invention may be made without departing from the spirit or scope thereof and it is to be understood that the invention is to be limited only as defined in the appended claims.

We claim:

1. A water barrier gel composition which comprises from about 0.1 to 5% by weight of water absorbent material selected from the group consisting of insoluble acrylic polymers and mixtures and copolymers thereof and starch-acrylic block polymers and from about 95 to 99.9% by weight of water, based on the weight of the total composition the particular water absorbent material and amount thereof being selected to produce a viscosity in the range of 10,000 to 500,000 centipoises.

2. The composition of claim 1 which comprises from about 0.1 to 2% by weight of water absorbent material and from about 98 to 99.9% by weight of water, based on the weight of the total composition.

3. The composition of claim 1 wherein the water absorbent material is selected from the group consisting of insoluble acrylic polymers and mixtures and copolymers thereof.

4. The composition of claim 3 wherein the water absorbent material is selected from the group consisting of insolubilized acrylic polymers and starch acrylic block polymers.

5. A method of protecting a surface from heat damage or preventing ignition which comprises applying to said surface a continuous layer of a water barrier gel composition of claim 1.

6. The method of claim 5 wherein the surface is horizontal or slopes up to an angle of about 45° from the horizontal.

7. The method of claim 5 wherein the surface slopes greater than about 45° from the horizontal or is vertical or overhead.

8. The method of claim 5 wherein the layer is from about 1 to 2 inches thick.

9. The method of claim 8 wherein the layer is about 1 inch thick.

10. The composition of claim 1 wherein the water absorbent materials comprised of 40 to 60% by weight of water insoluble acrylic polymers, 40 to 60% by weight of carboxymethylcellulose and up to 0.5% by weight of a non-cationic surfactant.

11. The composition of claim 10 wherein the water absorbent material is approximately equal parts by weight of a water-insoluble acrylic polymer and carboxymethylcellulose and about 0.1% by weight of sodium dioctyl sulfosuccinate.

12. The method of claim 5 wherein the water absorbent material is comprised of 40 to 60% by weight of water insoluble acrylic polymers, 40 to 60% by weight of carboxymethylcellulose and up to 0.5% by weight of an anionic surfactant.

13. The method of claim 5 wherein the water absorbent material is approximately equal parts by weight of a water-insoluble acrylic polymer and carboxymethylcellulose and about 0.1% by weight of sodium dioctyl sulfosuccinate.

14. The method of claim 5 wherein the water absorbent material is admixed with a member selected from the group consisting of polyvinylpyrrolidone, borated dextrin and methylcellulose.

15. The method of claim 5 wherein the water absorbent material is a mixture of water-insoluble acrylic polymers and a member of the group consisting of polyvinylpyrrolidone, borated dextrin and methylcellulose.

16. The composition of claim 1 wherein the viscosity is between 100,000 and 200,000 centipoises.

* * * * *